US008486883B2

(12) United States Patent
Schiedel et al.

(10) Patent No.: US 8,486,883 B2
(45) **Date of Patent: *Jul. 16, 2013**

(54) LIQUID WASHING OR CLEANING AGENT HAVING A POLYMER PREVENTING GRAYING

(75) Inventors: Marc-Steffen Schiedel, Düsseldorf (DE); Ulrich Pegelow, Düsseldorf (DE); Peter Schmiedel, Düsseldorf (DE); Evelyn Langen, Düsseldorf (DE); Sabine Schümann, Neuss (DE); Martina Hutmacher, Düsseldorf (DE); Heinz-Jürgen Völkel, Langenfeld (DE); Matthias Sunder, Düsseldorf (DE); Birgit Glüsen, Düsseldorf (DE); Cornelius Bessler, Düsseldorf (DE); Timothy O'Connell, Düsseldorf (DE); Stephan Gomolka, Rosenheim (DE); Eva-Maria Wikker, Düsseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/349,788

(22) Filed: Jan. 13, 2012

(65) Prior Publication Data

US 2012/0151683 A1 Jun. 21, 2012

Related U.S. Application Data

(63) Continuation of application No. PCT/EP2010/059585, filed on Jul. 5, 2010.

(30) Foreign Application Priority Data

Jul. 17, 2009 (DE) ..... 10 2009 027 812

(51) Int. Cl.

| | |
|---|---|
| ***C11D 1/00*** | (2006.01) |
| ***C11D 3/122*** | (2006.01) |
| ***C11D 3/22*** | (2006.01) |
| ***C11D 3/37*** | (2006.01) |
| ***B08B 3/04*** | (2006.01) |

(52) U.S. Cl.

USPC ..... 510/361; 510/351; 510/357; 510/434; 510/470; 510/471; 510/473; 510/477; 8/137

(58) Field of Classification Search

USPC ..... 510/351, 357, 361, 434, 470, 471, 510/473, 477; 8/137

See application file for complete search history.

(56) References Cited

U.S. PATENT DOCUMENTS

| | | | | |
|---|---|---|---|---|
| 4,379,061 | A * | 4/1983 | Rabitsch et al. | 510/361 |
| 5,500,153 | A * | 3/1996 | Figueroa et al. | 510/292 |
| 5,573,701 | A * | 11/1996 | Bulfari et al. | 510/397 |
| 2004/0102346 | A1 | 5/2004 | Carr et al. | |

FOREIGN PATENT DOCUMENTS

| | | | |
|---|---|---|---|
| EP | 0054325 | B1 | 4/1984 |
| EP | 0133566 | A2 | 2/1985 |
| EP | 0237075 | A2 | 9/1987 |
| GB | 965215 | A | 7/1964 |
| GB | 2279660 | A | 1/1995 |

OTHER PUBLICATIONS

PCT International Search Report (PCT/EP2010/059585) dated Jun. 10, 2010.

* cited by examiner

*Primary Examiner* — Brian P Mruk

(74) *Attorney, Agent, or Firm* — Thomas G. Krivulka

(57) ABSTRACT

The invention relates to the use of an anionic polymer in a liquid washing or cleaning agent for inhibiting graying when washing and/or cleaning textile web materials, and acrylic acid homopolymers comprising liquid washing and cleaning agents.

4 Claims, No Drawings

LIQUID WASHING OR CLEANING AGENT HAVING A POLYMER PREVENTING GRAYING

CROSS-REFERENCES TO RELATED APPLICATIONS

This application is a continuation of PCT/EP2010/059585, filed on Jul. 5, 2010, which claims priority under 35 U.S.C. §119 to DE 10 2009 027 812.5 filed on Jul. 17, 2009, both of which are hereby incorporated by reference.

FIELD OF THE INVENTION

The present invention generally relates to a liquid washing or cleaning agent, comprising surfactant(s), water and a graying-inhibiting polymer.

BACKGROUND OF THE INVENTION

In order to increase the washing or cleaning power of washing or cleaning agents, these often comprise one or more additives. For example, in order to prevent a redeposition of finely dispersed, previously released dirt, washing agents comprise so-called graying inhibitors, such as for example carboxymethyl cellulose.

Thus, EP 054325 A1 describes a washing agent with carboxymethyl cellulose as the graying inhibitor.

Due to the low solubility of carboxymethyl cellulose in liquid washing or cleaning agents, a liquid washing or cleaning agent that comprises carboxymethyl cellulose as the graying inhibitor has so far not been available on the market. Another problem consists in that stable dispersions of the carboxymethyl cellulose in the matrix of a washing or cleaning agent are very difficult to obtain, and precipitations and phase separations occur during the storage of a carboxymethyl cellulose-containing washing or cleaning agent. In addition, on adding carboxymethyl cellulose to liquid washing or cleaning agents, an undesirable strong increase of the viscosity occurs.

All this leads to the fact that when powdered washing agents are used, into which the carboxymethyl cellulose can be incorporated without problem, there occurs a significantly lower graying of the washing than when liquid washing agents are used.

Accordingly, it is desirable to provide a stable liquid washing or cleaning agent with a graying inhibitor.

This object is achieved by the use of an anionic polymer in a liquid washing or cleaning agent, containing water and surfactant, for graying inhibition when washing and/or cleaning textile fabrics.

Furthermore, other desirable features and characteristics of the present invention will become apparent from the subsequent detailed description of the invention and the appended claims, taken in conjunction with this background of the invention.

BRIEF SUMMARY OF THE INVENTION

The present invention relates to a liquid washing or cleaning agent, comprising water, 0.1 to 60 wt % surfactant and 0.5 to 6 wt % of an acrylic acid homopolymer having an average molecular weight Mw of 4500.

The present invention also relates to a liquid washing or cleaning agent, comprising water, 0.1 to 60 wt % surfactant and 0.5 to 6 wt % of an acrylic acid homopolymer having an average molecular weight Mw of 1200.

The present invention further relates to a liquid washing or cleaning agent, comprising water, 0.1 to 60 wt % surfactant, 0.1 to 5 wt % of a graying-inhibiting polysaccharide, 0.05 to 1 wt % xanthan, 1 to 20 wt % sodium sulfate and 0.15 to 20 wt % of an acrylic acid homopolymer having an average molecular weight Mw of 4500.

Also, the present invention relates to a liquid washing or cleaning agent, comprising water, 0.1 to 60 wt % surfactant, 0.1 to 5 wt % of a graying-inhibiting polysaccharide, 0.05 to 1 wt % xanthan, 1 to 20 wt % sodium sulfate and 0.15 to 20 wt % of an acrylic acid homopolymer having an average molecular weight Mw of 1200.

In addition, the present invention relates to a method of using an anionic polymer in a liquid washing or cleaning agent, containing water and surfactant, for graying inhibition when washing and/or cleaning textile fabrics.

The present invention also relates to a method of using an anionic polymer in a liquid washing or cleaning agent, containing water, surfactant and a graying-inhibiting polysaccharide, for increasing the graying inhibition action of the washing or cleaning agent when washing and/or cleaning textile fabrics.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

It has been surprisingly found that anionic polymers possess a graying-inhibiting action in liquid, aqueous washing or cleaning agents.

Furthermore, it has been shown that the use of an anionic polymer in a liquid washing or cleaning agent, containing water, surfactant and a graying-inhibiting polysaccharide, leads to an increase in the graying inhibition action of the washing or cleaning agent when washing and/or cleaning textile fabrics.

The anionic polymer is preferably selected from the group that includes acrylic polymers, polyamino acids, polyuronic acids, polyvinyl sulfonic acids, polyalkene dicarboxylic acids and mixtures thereof. Particularly preferred polymers include acrylic acid homopolymers, acrylic acid copolymers, methacrylic acid homopolymers, methacrylic acid copolymers, polyaspartic acids, poly-D-galacturonic acid, poly-D-glucuronic acid, poly-L-iduronic acid, alginic acid, hyaluronic acid, vinylsulfonic acid homopolymers, vinylsulfonic acid copolymers, maleic acid homopolymers, maleic acid copolymers, fumaric acid homopolymers, fumaric acid copolymers and mixtures thereof. These anionic (co)polymers are either highly water-soluble or can be stably dispersed in the matrix of an aqueous liquid washing or liquid cleaning agent, without the occurrence of precipitation, phase separation and/or strongly increased viscosity.

If the anionic polymer serves to increase the graying-inhibiting action of a washing or cleaning agent that comprises a graying-inhibiting polysaccharide, it is advantageous if the graying-inhibiting polysaccharide is selected from the group that includes carboxymethyl cellulose (CMC), ether sulfonic acid salts of starch, ether sulfonic acid salts of cellulose, acidic sulfuric acid ester salts of cellulose, acidic sulfuric acid ester salts of starch, methyl cellulose, ethyl cellulose, hydroxyethyl cellulose, hydroxypropyl cellulose methyl hydroxyethyl cellulose, methyl carboxymethyl cellulose, ethyl hydroxyethyl cellulose and mixtures thereof. The graying-inhibiting polysaccharide carboxymethyl cellulose, in particular sodium carboxymethyl cellulose, is quite particularly preferred.

These preferred graying-inhibiting polysaccharides, in combination with the anionic polymer, afford a particularly good antigray effect to washing or cleaning agents.

The invention further relates to the use of an anionic polymer in a liquid washing or cleaning agent, containing water and surfactant for graying inhibition when washing and/or cleaning textile fabrics at 10 to 30° C.

Moreover, the invention relates to the use of an anionic polymer in a liquid washing or cleaning agent, containing water, surfactant and a graying-inhibiting polysaccharide, for increasing the graying inhibition action of the washing or cleaning agent when washing and/or cleaning textile fabrics at 10 to 30° C.

In another aspect the invention relates to a liquid washing or cleaning agent, comprising water, 0.1 to 60 wt % surfactant and 0.5 to 6 wt % of an acrylic acid homopolymer having an average molecular weight Mw of 1200 or 4500.

Particularly stable liquid washing or cleaning agents that in regard to their graying inhibition are effective are obtained by the use of acrylic acid homopolymers having an average molecular weight Mw of 1200 or 4500.

In yet another aspect the invention relates to a liquid washing or cleaning agent, comprising water, 0.1 to 60 wt % surfactant, 0.1 to 5 wt % of a graying-inhibiting polysaccharide, 0.05 to 1 wt % xanthan, 1 to 20 wt % sodium sulfate and 0.5 to 20 wt % of an acrylic acid homopolymer having an average molecular weight Mw of 1200 or 4500.

By adding acrylic acid homopolymers having an average molecular weight Mw of 1200 or 4500, liquid washing or cleaning agents are obtained with an exceptionally high graying inhibition. Due to the combination of xanthan and sodium sulfate, the matrix of the liquid washing or cleaning agent exhibits a surfactant-rich micro phase and a continuous, surfactant-poor phase, wherein the surfactant-rich phase is dispersed in the continuous, surfactant-poor phase. This particular structure enables graying-inhibiting polysaccharides, especially sodium carboxymethyl cellulose, to disperse in a storage stable manner. The graying-inhibiting action of the polysaccharides is synergistically further boosted by the presence of an acrylic acid homopolymer having an average molecular weight of 1200 or 4500.

The invention is described below in more detail inter alia by means of examples.

An anionic polymer is inventively incorporated in a liquid washing or cleaning agent for graying-inhibition.

The anionic polymer preferably includes acrylic polymers, polyamino acids, polyuronic acids, polyvinyl sulfonic acids, polyalkene dicarboxylic acids and mixtures thereof.

In the context of this invention, the term acrylic polymer is understood to mean homopolymers or copolymers that comprise at least acrylic acid or methacrylic acid as a monomer. In the context of this invention, the designation polyamino acids does not include the natural homopolymers or copolymers of this polymer class (for example proteins), but rather the synthetic polycondensation products mainly consisting of α-amino acids.

Polyuronic acids include homopolymers or copolymers of these sugar acids. The term polyvinyl sulfonic acids includes homopolymers or copolymers that comprise vinyl sulfonic acid as a monomer. In the context of this invention, the term polyalkene dicarboxylic acids includes for example homopolymers or copolymers with maleic acid or fumaric acid as a monomer.

Particularly preferred polymers include acrylic acid homopolymers, acrylic acid copolymers, methacrylic acid homopolymers, methacrylic acid copolymers, polyaspartic acids, poly-D-galacturonic acid, poly-D-glucuronic acid, poly-L-iduronic acid, alginic acid, hyaluronic acid, vinylsulfonic acid homopolymers, vinylsulfonic acid copolymers, maleic acid homopolymers, maleic acid copolymers, fumaric acid homopolymers, fumaric acid copolymers and mixtures thereof.

The alkali metal salts of the homopolymers of acrylic acid or of methacrylic acid are particularly preferably employed. They can have an average molecular weight Mw of 600 to 750 000. Due to their superior solubility, however, short-chain homopolymers of both monomers with an average molecular weight Mw of 1000 to 15 000, and particularly preferably 1000 to 8000, are particularly advantageous.

Further suitable copolymeric polycarboxylates are particularly those of acrylic acid with methacrylic acid and of acrylic acid or methacrylic acid with maleic acid. In order to improve the water solubility, the polymers can also comprise allyl sulfonic acids, such as allyloxybenzene sulfonic acid and methallyl sulfonic acid as the monomer.

Exemplary suitable acrylic and methacrylic (co)polymers include the high molecular weight homopolymers of acrylic acid, crosslinked with a polyalkenyl polyether, in particular an allyl ether of saccharose, pentaerythritol or propylene (INCI name according to the "International Dictionary of Cosmetic Ingredients" of "The Cosmetic, Toiletry and Fragrance Association (CTFA)": Carbomer), which are also called carboxyvinyl polymers. Polyacrylic acids of this type are available under the trade names Polygel® and Carbopol®.

For example, the following acrylic acid copolymers are also suitable: (i) copolymers of acrylic acid and/or methacrylic acid (INCI Acrylates Copolymer), which are available for example under the trade names Aculyn®, Acusol® or Tego® Polymer; (ii) crosslinked high molecular weight acrylic acid copolymers, to which belong for example the copolymers of $C_{10-30}$ alkyl acrylates with acrylic acid and/or methacrylic acid, crosslinked with an allyl ether of saccharose or of pentaerythritol (INCI Acrylates/$C_{10-30}$ Alkyl Acrylate Crosspolymer) and which are available for example under the trade name Carbopol®. Further suitable polymers are (meth)acrylic acid (co)polymers of the Sokalan® type.

Further suitable anionic polymers include copolymers of acrylic acid, ethyl acrylate and the sodium salt of 2-methyl-2-[(1-oxo-2-propen-1-yl)amino]-1-propane sulfonate, copolymers of 4-styrene sulfonic acid and maleic acid, poly-2-acrylamido-2-methyl-1-propane sulfonic acid or copolymers of acrylic acid and acrylamide.

Although in the context of this invention the acids are mentioned with reference to the anionic polymers and their monomers, the cited (co)polymers are added in at least partially neutralized form, namely in the form of their alkali metal salts, preferably sodium salts.

The anionic polymer is added in an amount of 0.15 to 20 wt %, based on the total washing or cleaning agent. The anionic polymer is particularly preferably added in an amount of 0.5 to 6 wt %, based on the total washing or cleaning agent.

In addition to the anionic polymer, the washing or cleaning agent comprises surfactant(s), wherein anionic, non-ionic, zwitterionic and/or amphoteric surfactants can be employed. Mixtures of anionic and non-ionic surfactants are preferred from the industrial application viewpoint. The total surfactant content of the liquid washing or cleaning agent is preferably below 60 wt % and particularly preferably below 45 wt %, based on the total liquid washing or cleaning agent.

Suitable non-ionic surfactants include alkoxylated fatty alcohols, alkoxylated fatty acid alkyl esters, fatty acid amides, alkoxylated fatty acid amides, polyhydroxyfatty acid amides, alkylphenol polyglycol ethers, amine oxides, alkyl polyglucosides and mixtures thereof.

Preferred non-ionic surfactants are alkoxylated, advantageously ethoxylated, particularly primary alcohols preferably containing 8 to 18 carbon atoms and, on average, 1 to 12 moles of ethylene oxide (EO) per mole of alcohol, in which the alcohol group may be linear or, preferably, methyl-branched in the 2-position or may contain e.g. linear and methyl-branched groups in the form of the mixtures typically present in Oxo alcohol groups. In particular, however, alcohol ethoxylates with linear alcohol groups of natural origin with 12 to 18 carbon atoms, for example from coco-, palm-, tallow- or oleyl alcohol, and an average of 2 to 8 EO per mole alcohol are preferred. Exemplary preferred ethoxylated alcohols include $C_{12-14}$ alcohols with 3 EO, 4 EO or 7 EO, $C_{9-11}$ alcohols with 7 EO, $C_{13-15}$ alcohols with 3 EO, 5 EO, 7 EO or 8 EO, $C_{12-18}$ alcohols with 3 EO, 5 EO or 7 EO and mixtures thereof, such as mixtures of $C_{12-14}$ alcohol with 3 EO and $C_{12-18}$ alcohol with 7 EO. The cited degrees of ethoxylation constitute statistically average values that can be a whole or a fractional number for a specific product. Preferred alcohol ethoxylates have a narrowed homolog distribution (narrow range ethoxylates, NRE). In addition to these non-ionic surfactants, fatty alcohols with more than 12 EO can also be used. Examples of these are tallow fatty alcohol with 14 EO, 25 EO, 30 EO or 40 EO. Also, non-ionic surfactants that comprise EU and PO groups together in the molecule are employable according to the invention. Further suitable is also a mixture of a (highly) branched ethoxylated fatty alcohol and a linear ethoxylated fatty alcohol, such as for example a mixture of a $C_{16-18}$ fatty alcohol with 7 EO and 2-propylheptanol with 7 EO. The washing, cleaning, post-treatment or auxiliary washing agent particularly preferably comprises a $C_{12-18}$ fatty alcohol with 7 EO or a $C_{13-15}$ oxoalcohol with 7 EO as the non-ionic surfactant.

The content of non-ionic surfactants in the washing or cleaning agent is preferably 3 to 40 wt %, advantageously 5 to 30 wt % and particularly 7 to 20 wt %, in each case based on the total washing or cleaning agent.

In addition to the non-ionic surfactants, the washing or cleaning agent can also comprise anionic surfactants. Sulfonates, sulfates, soaps, alkyl phosphates, anionic silico-surfactants and mixtures thereof are preferably employed as the anionic surfactant.

Suitable surfactants of the sulfonate type are, advantageously $C_{9-13}$ alkylbenzene sulfonates, olefin sulfonates, i.e. mixtures of alkene- and hydroxyalkane sulfonates and disulfonates, as are obtained, for example, from $C_{12-18}$ monoolefins having a terminal or internal double bond, by sulfonation with gaseous sulfur trioxide and subsequent alkaline or acidic hydrolysis of the sulfonation products. $C_{12-18}$ Alkane sulfonates and the esters of α-sulfofatty acids (ester sulfonates), for example the α-sulfonated methyl esters of hydrogenated coco-, palm nut- or tallow acids are likewise suitable.

Preferred alk(en)yl sulfates are the alkali metal and especially sodium salts of the sulfuric acid half-esters derived from the $C_{12}$-$C_{18}$ fatty alcohols, for example from coconut butter alcohol, tallow alcohol, lauryl, myristyl, cetyl or stearyl alcohol or from $C_{10}$-$C_{20}$ oxo alcohols and those half-esters of secondary alcohols of these chain lengths. The $C_{12}$-$C_{16}$ alkyl sulfates and $C_{12}$-$C_{15}$ alkyl sulfates as well as $C_{14}$-$C_{15}$ alkyl sulfates are preferred on the grounds of washing performance. 2,3-Alkyl sulfates are also suitable anionic surfactants.

Sulfuric acid mono-esters derived from straight-chain or branched $C_{7-21}$ alcohols ethoxylated with 1 to 6 moles ethylene oxide are also suitable, for example 2-methyl-branched $C_{9-11}$ alcohols with an average of 3.5 mole ethylene oxide (EO) or $C_{12-18}$ fatty alcohols with 1 to 4 EO.

Soaps are also preferred anionic surfactants. Saturated and unsaturated fatty acid soaps are suitable, such as the salts of lauric acid, myristic acid, palmitic acid, stearic acid, (hydrogenated) erucic acid and behenic acid, and especially soap mixtures derived from natural fatty acids such as coconut oil fatty acid, palm kernel oil fatty acid, olive oil fatty acid or tallow fatty acid.

The anionic surfactants, including the soaps, can be present in the form of their sodium, potassium or magnesium or ammonium salts. The anionic surfactants are preferably present in the form of their sodium salts Further preferred counter ions for the anionic surfactants are also the protonated forms of choline, triethylamine or methylethylamine.

The content of anionic surfactants in a washing or cleaning agent is 1 to 40 wt %, advantageously 5 to 30 wt % and quite particularly preferably 10 to 25 wt %, in each case based on the total washing or cleaning agent.

In one embodiment of the invention, the anionic polymer is incorporated in a liquid washing or cleaning agent that comprises a stably dispersed, graying-inhibiting polysaccharide in order to boost the graying-inhibiting action of the washing or cleaning agent.

The liquid washing or cleaning agent preferably comprises carboxymethyl cellulose (CMC), an ether sulfonic acid salt of starch, an ether sulfonic acid salt of cellulose, an acidic sulfuric acid ester salt of cellulose, an acidic sulfuric acid ester salt of starch, methyl cellulose, ethyl cellulose, hydroxyethyl cellulose, hydroxypropyl cellulose methyl hydroxyethyl cellulose, methyl carboxymethyl cellulose, ethyl hydroxyethyl cellulose or a mixture of these graying-inhibiting polysaccharides as the graying-inhibiting polysaccharide. The graying-inhibiting polysaccharide carboxymethyl cellulose, in particular sodium carboxymethyl cellulose, is quite particularly preferred.

The amount of graying-inhibiting polysaccharide is 0.1 to 5 wt %, based on the total amount of the washing or cleaning agent. The amount of graying-inhibiting polysaccharide is preferably 0.2 to 4 wt % and quite particularly preferably between 0.5 and 3 wt %, each based on the total amount of the washing or cleaning agent.

The anionic polymers are incorporated in liquid washing or cleaning agents, wherein the agents comprise water as the main solvent. In addition, non-aqueous solvents can be added to the washing or cleaning agent. Suitable non-aqueous solvents include mono- or polyhydric alcohols, alkanolamines or glycol ethers, in so far that they are miscible with water in the defined concentration range. The solvents are preferably selected from ethanol, n-propanol, i-propanol, butanols, glycol, propane diol, butane diol, glycerin, diglycol, propyl diglycol, butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether as well as mixtures of these solvents. Non-aqueous solvents can be added to the washing or cleaning agent in amounts between 0.5 and 15 wt %, preferably, however below 12 wt %.

In addition to the anionic polymer, to the surfactant(s) and to the optional graying-inhibiting polysaccharide, the washing or cleaning agent can comprise additional ingredients that further improve the application technological and/or esthetic properties of the washing or cleaning agent. In the context of the present invention, the washing or cleaning agent preferably additionally comprises one or a plurality of substances from the group of the builders, bleaching agents, bleach catalysts, bleach activators, enzymes, electrolytes, non-aqueous solvents, pH adjustors, perfumes, perfume carriers, fluorescent agents, dyes, hydrotropes, foam inhibitors, silicone oils, soil-release polymers, additional graying inhibitors, shrink preventers, anti-crease agents, color transfer inhibitors, antimicrobials, germicides, fungicides, antioxidants, preservatives, corrosion inhibitors, antistats, bittering agents, ironing aids, water-repellents and impregnation agents, swelling and non-skid agents, softening components and UV-absorbers.

In the following Table 1 are shown the compositions of two washing or cleaning agents E1 and E2 as well as the composition of a comparative formulation V1 (all amounts are given in wt. % active substance, based on the composition).

TABLE 1

Compositions of the washing or cleaning agents E1, E2 and V1

| | E1 | E2 | V1 |
|---|---|---|---|
| Linear $C_{10}$-$C_{13}$ alkylbenzene sulfonic acid, Na salt | 21.4 | 21.4 | 21.4 |
| $C_{12-18}$ fatty alcohol with 7 EO | 10 | 10 | 10 |
| Xanthan | 0.1 | 0.1 | 0.1 |
| Polyacrylic acid (MW = ~1.200) | — | 4 | — |
| Polyacrylic acid (MW = ~4.500) | 4 | — | — |
| Citric acid, Na salt | 2.5 | 2.5 | 2.5 |
| Phosphonic acid, Na salt | 0.8 | 0.8 | 0.8 |
| Boric acid, Na salt | 1.06 | 1.06 | 1.06 |
| Carboxymethyl cellulose, Na salt | 1.4 | — | — |
| Optical brightener | 0.08 | 0.08 | 0.08 |
| 1,2-propane diol | 5 | 5 | 5 |
| Ethanol | 3.5 | 3.5 | 3.5 |
| Silicone defoamer | 0.05 | 0.05 | 0.05 |
| Cellulase | 0.1 | 0.1 | 0.1 |
| Additional enzymes (amylase & protease) | 2 | 2 | 2 |
| Sodium sulfate | 5 | 5 | 5 |
| Perfume | 1.5 | 1.5 | 1.5 |
| Colorant | + | + | + |
| water | ad 100 | ad 100 | ad 100 |

Both washing or cleaning agents E1 and E2 were storage stable for a plurality of weeks.

In order to demonstrate the graying-inhibiting action of the polyacrylate, the washing or cleaning agents E2 and V1 as well as a commercial powdered washing agent V2 (Na carboxymethyl cellulose content: 1.4 wt %), a commercial liquid washing agent V3 (total surfactant content ~33 wt %) and another commercial liquid washing agent V4 (total surfactant content ~15 wt %) were subjected to a washing test. Both liquid washing agents V3 and V4 comprised no graying-inhibiting polysaccharide and the sodium salt of citric acid as the builder.

A domestic washing machine (Miele W 526) was used in the washing tests and was loaded with 3.5 kg test fabrics (WFK 10 A or WFK 20 A) and 4 SBL 2004 towels with standardized soiling (32 g soil ballast). Six consecutive washes were carried out at 20° C. (dose: E2=76 g, V1=76 g, V2=80 g, V3=81 g and V4=78 g) and then the washing was hung out to dry. The white degree was determined spectrophotometrically according to Ganz/Grieser (see Table 2).

TABLE 2

White degree according to Ganz/Grieser

| Washing or cleaning agent | WFK 10A | WFK 20A |
|---|---|---|
| E2 | 174.6 | 135.2 |
| V1 | 159.4 | 120.2 |
| V2 | 176.1 | 136.5 |
| V3 | 165.5 | 131.4 |
| V4 | 142.6 | 116.9 |

The values clearly show that the washing that was treated with the inventive washing or cleaning agent E2 exhibits clearly higher white degrees and has consequently become less strongly gray than the washing that was treated with the comparative formulations V1, V3 and V4.

The values also show that the washing or cleaning agent E2 exhibits a similar good graying inhibition to a powdered washing agent.

In another washing test, it was shown that the washing or cleaning agent E1 even exhibits a clearly stronger graying-inhibiting action than the powdered washing agent V2.

For this, a domestic washing machine (Miele W 526) was loaded with 3.5 kg of lightly soiled, white washing consisting of various materials (cotton, polyester, polyamide, mixed wovens, etc.). Five consecutive washes were carried out at 40° C. (dosing: E1=76 g and V2=80 g) and then after the washing was hung out to dry the brightness values (Y-value of the tristimulus values {X, Y, Z}) were determined spectrophotometrically. The average value for all fabrics that were treated with the washing or cleaning agent E1 was 83 and the average value for all fabrics that were treated with the solid washing or cleaning agent V2 was 80.9.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A liquid washing or cleaning agent, comprising:
water,
0.1 to 60 wt % surfactant,
0.1 to 5 wt % of a graying-inhibiting polysaccharide,
0.05 to 1 wt % xanthan,
1 to 20 wt % sodium sulfate and
0.15 to 20 wt % of an acrylic acid homopolymer having an average molecular weight Mw of 4500.

2. A liquid washing or cleaning agent, comprising:
water,
0.1 to 60 wt % surfactant,
0.1 to 5 wt % of a graying-inhibiting polysaccharide,
0.05 to 1 wt % xanthan,
1 to 20 wt % sodium sulfate and
0.15 to 20 wt % of an acrylic acid homopolymer having an average molecular weight Mw of 1200.

3. A method for washing and/or cleaning textile fabrics wherein textiles are treated with the liquid washing or cleaning agent according to claim 1 in a washing machine.

4. A method for washing and/or cleaning textile fabrics wherein textiles are treated with the liquid washing or cleaning agent according to claim 2 in a washing machine.

* * * * *